US011347168B1

(12) United States Patent
Ueta

(10) Patent No.: US 11,347,168 B1
(45) Date of Patent: May 31, 2022

(54) IMAGE FORMING APPARATUS

(71) Applicant: TOSHIBA TEC KABUSHIKI KAISHA, Tokyo (JP)

(72) Inventor: Tsutomu Ueta, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/209,822

(22) Filed: Mar. 23, 2021

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 10,824,103 B1 * 11/2020 Doi ..... G03G 15/2053
2020/0257229 A1 * 8/2020 Sato ..... G03G 15/2064

FOREIGN PATENT DOCUMENTS

JP 2009-122467 6/2009
JP 2010-201702 9/2010

* cited by examiner

*Primary Examiner* — Clayton E. LaBalle
*Assistant Examiner* — Michael A Harrison
(74) *Attorney, Agent, or Firm* — Foley & Lardner LLP

(57) ABSTRACT

A method for printing on a print medium includes acquiring print information regarding a target image to be applied to the print medium; acquiring position information from a reader regarding a position of a wireless tag on the print medium; determining a heating region based on the print information and a non-heating region based on the position information; determining whether the heating region and the non-heating region at least partially overlap; performing an image adjustment process to manipulate the target image to eliminate an overlap between the heating region and the non-heating region in response to determining that the heating region and the non-heating region at least partially overlap; controlling an image forming assembly to apply a toner image of the target image to the print medium; and controlling a fixing device to heat the toner image to fix the toner image on the print medium.

20 Claims, 8 Drawing Sheets

IMAGE FORMING APPARATUS

FIELD

Embodiments described herein relate generally to image forming apparatuses.

BACKGROUND

An image forming apparatus capable of writing tag information on a wireless tag during conveying of a print medium attached with a wireless tag is known. In such image forming apparatuses, when an image is fixed on the print medium by heating the print medium, a wireless tag region to which the wireless tag is attached in the region on the print medium is not heated. Such image forming apparatuses can prevent the wireless tag from generating defects due to heating of the wireless tag region.

DETAILED DESCRIPTION

Figure 1:
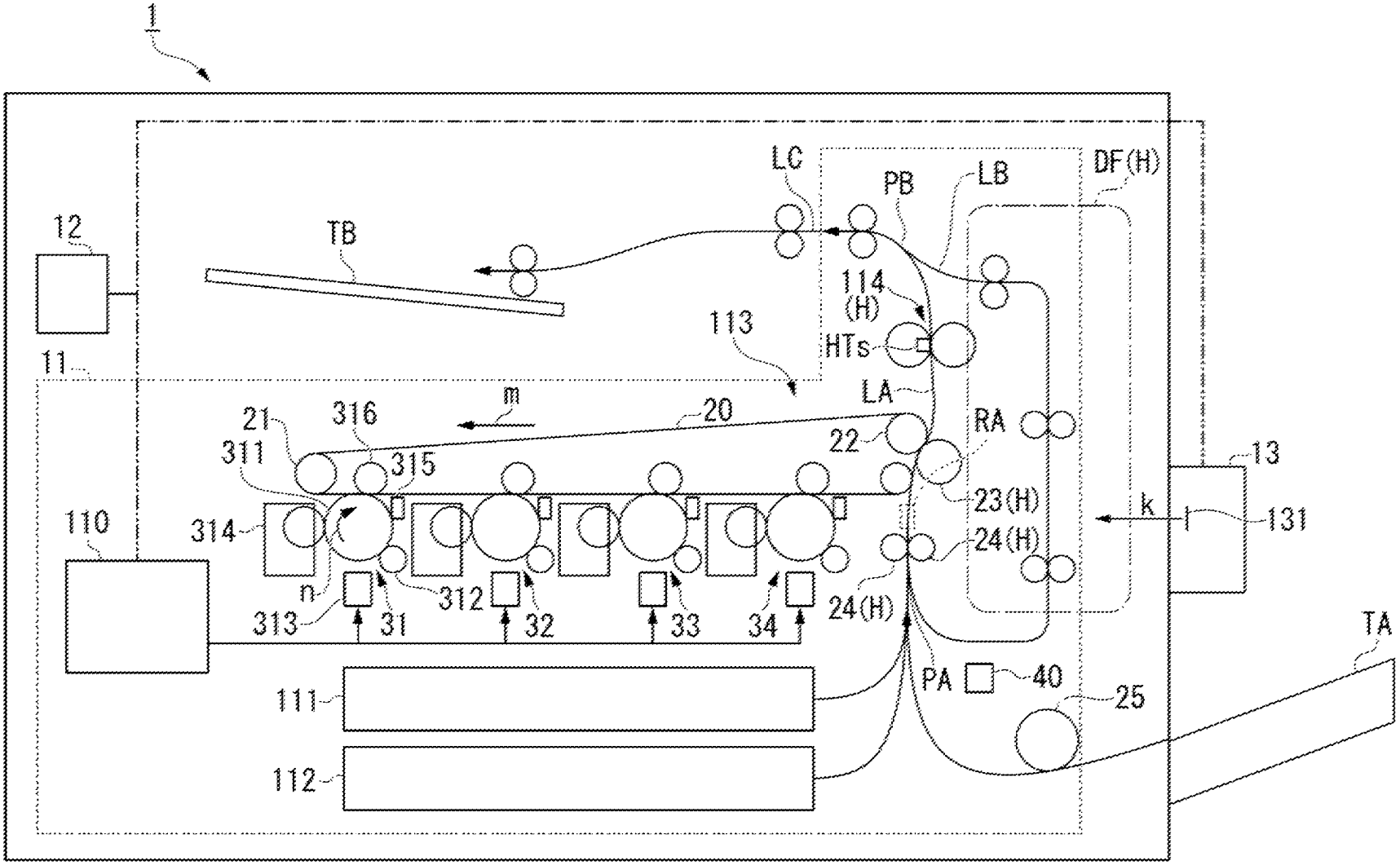
FIG. 1 is a diagram illustrating an example of a configuration of an image forming apparatus according to at least one embodiment.

According to the techniques of the image forming apparatuses discussed above, in some cases, a portion of the image printed on the print medium, that is, the image that needs to be printed on the wireless tag region, is lost without being printed on the print medium. The present disclosure addresses these issues. An image forming apparatus according to at least one embodiment will be described with reference to the drawings. In each figure, the same components are denoted by the same reference numerals. As an example of the image forming apparatus according to at least one embodiment, an image forming apparatus 1 will be described.

Configuration of Image Forming Apparatus

The configuration of the image forming apparatus 1 will be described with reference to FIG. 1. FIG. 1 is a diagram illustrating an example of the configuration of the image forming apparatus 1 according to at least one embodiment.

The image forming apparatus 1 is an apparatus that forms an image on a print medium. For example, the image forming apparatus 1 is a multifunction device, a copier, a printer, or the like. For the convenience of explanation, the image formed by the image forming apparatus 1 on the print medium will be referred to as a target image. The print medium is a medium as a target on which the image forming apparatus 1 performs processing such as forming the target image. The print medium may be any medium as long as the print medium is a sheet-like medium upon which the target image can be formed along at least one side thereof. For example, the print medium is print paper, a plastic film, or the like.

The image forming apparatus 1 specifies a type of print medium as a target on which the process desired by the user according to the operation received from the user is performed. The types of the print media are classified according to a size of the print medium, thickness of the print medium, a material of the print medium, presence or absence of the wireless tag, and the like. A print medium having a wireless tag is a print medium attached with one or more wireless tags. A print medium having no wireless tag is a print medium attached with no wireless tag. The wireless tag is, for example, a radio frequency identification (RFID) tag, but the wireless tag is not limited thereto.

Position information indicating the position of each wireless tag on the print medium is written in each of the one or more wireless tags attached to the print medium. In other words, each of the one or more wireless tags stores the position information indicating the position of each wireless tag on the print medium. For example, the position information indicating a position of a wireless tag XY on a print medium XX is written in the certain wireless tag XY attached to the certain print medium XX. The image forming apparatus 1 can read the position information from the print medium having the wireless tag.

The image forming apparatus 1 forms a target image on the print medium of a type specified in advance according to an operation received from the user.

When the print medium of the type specified in advance is a print medium having a wireless tag according to the operation received from the user, the image forming apparatus 1 reads the position information indicating the position of each wireless tag on the print medium from each of the one or more wireless tags attached to the print medium.

When the position information is read from each wireless tag, the image forming apparatus 1 selects a region to be heated in order to fix the target image formed on the print medium as a heating region based on the one or more read position information. More specifically, the image forming apparatus 1 selects the region that does not include the positions of one or more wireless tags among the regions on the print medium as such a heating region.

After selecting the heating region, the image forming apparatus 1 determines whether or not the image formation region in which the target image is formed among the regions on the print medium and the non-heating region which is not selected as the heating region among the regions on the print medium overlap each other. When the image forming apparatus 1 determines that the image formation region and the non-heating region do not overlap each other, the image forming apparatus 1 forms an image on the print medium. On the other hand, when the image forming apparatus 1 determines that the image formation region and the non-heating region overlap each other, the image forming apparatus 1 performs an image process of eliminating the overlap between the image formation region and the non-heating region on the target image. After that, the image forming apparatus 1 forms a toner image of the target image after performing the image process on the print medium. After forming the toner image of the target image on the print medium, the image forming apparatus 1 heats the selected heating region and fixes the toner image of the target image on the print medium as the target image. Accordingly, the image forming apparatus 1 can prevent the wireless tag from being defective due to the heating of the wireless tag without losing the target image formed on the print medium.

The image forming apparatus 1 includes, for example, a printer unit 11 (a printer), a control panel 12, a wireless tag communication device 13 (a communication device, a reader, a detector, etc.), a manual feed tray TA, and a paper ejection tray TB. The image forming apparatus 1 may be configured to include the printer unit 11, the control panel 12, the wireless tag communication device 13, the manual feed tray TA, the paper ejection tray TB, and other components, other devices, and the like.

The printer unit 11 includes a control unit 110 (a control system, a controller, a processing circuit, etc.), a first paper feed cassette 111, a second paper feed cassette 112, an image formation unit 113 (an image forming assembly), and a fixing device 114. The printer unit 11 may be configured to include the control unit 110, the paper feed cassette 111, the paper feed cassette 112, the image formation unit 113, the fixing device 114, and other components, other devices, and the like. The image formation unit 113 may be configured to include the fixing device 114.

The control unit 110 controls the entire image forming apparatus 1. In other words, the control unit 110 controls each of the printer unit 11, the control panel 12, the wireless tag communication device 13, the image formation unit 113, and the fixing device 114.

The paper feed cassette 111 stores the print medium of the type desired by the user. As an example, a case where the print medium PP having the wireless tag TG is stored in the paper feed cassette 111 will be described.

The paper feed cassette 112 stores the print medium of the type desired by the user. As an example, a case where the print medium having no wireless tag is stored in the paper feed cassette 112 will be described.

The control panel 12 includes an operation reception unit (a user interface) and a display unit (a display).

The operation reception unit receives operations from the user. The operation reception unit is an input device, for example, a touch pad, an input key, or the like. The operation reception unit outputs information indicating the operation received from the user to the control unit 110.

The display unit displays an image corresponding to the operation received via the operation reception unit. The display unit is an image display apparatus, for example, a liquid crystal display, an organic electro luminescence (EL) display, or the like. The display unit may be integrally configured with the operation reception unit as a touch panel.

The image formation unit 113 conveys the print medium and forms the toner image on the print medium according to the control of the control unit 110. This toner image is a toner image of the target image indicated by the image data acquired from the control unit 110. The configuration of the image formation unit 113 will be described in greater detail herein.

The fixing device 114 fixes the toner image formed on the print medium by the image formation unit 113 as a target image on the print medium. The fixing device 114 includes a plurality of heat generating bodies or components (e.g., heaters, heating elements, resistive heating elements, etc.). The plurality of heat generating bodies are components that generate heat by allowing current to flow therethrough, and are, for example, components including a resistor element or the like having a predetermined electric resistance. The region on the print medium is virtually divided into a plurality of division regions associated with the respective plurality of heat generating bodies so as not to overlap each other. A portion or all of these plurality of division regions may be regions that do not partially overlap with each other, or may be regions that partially overlap with each other. As an example, a case where all of these plurality of division regions are regions that do not partially overlap with each other will be described. As described above, the fixing device 114 is a plurality of heat generating bodies associated with the respective plurality of different division regions on the print medium and includes a plurality of heat generating bodies that heat the print medium. In FIG. 1, these plurality of heat generating bodies are illustrated as a heat generating body group HTs.

The fixing device 114 heats at least a portion of the region on the print medium by heating at least a portion of these plurality of heat generating bodies according to the control of the control unit 110. Accordingly, the fixing device 114 can fix the toner image formed on the print medium by the image formation unit 113 as the target image on the print medium. Among the plurality of heat generating bodies, one or more heat generating bodies to be heated are selected by the control unit 110.

Figure 2:
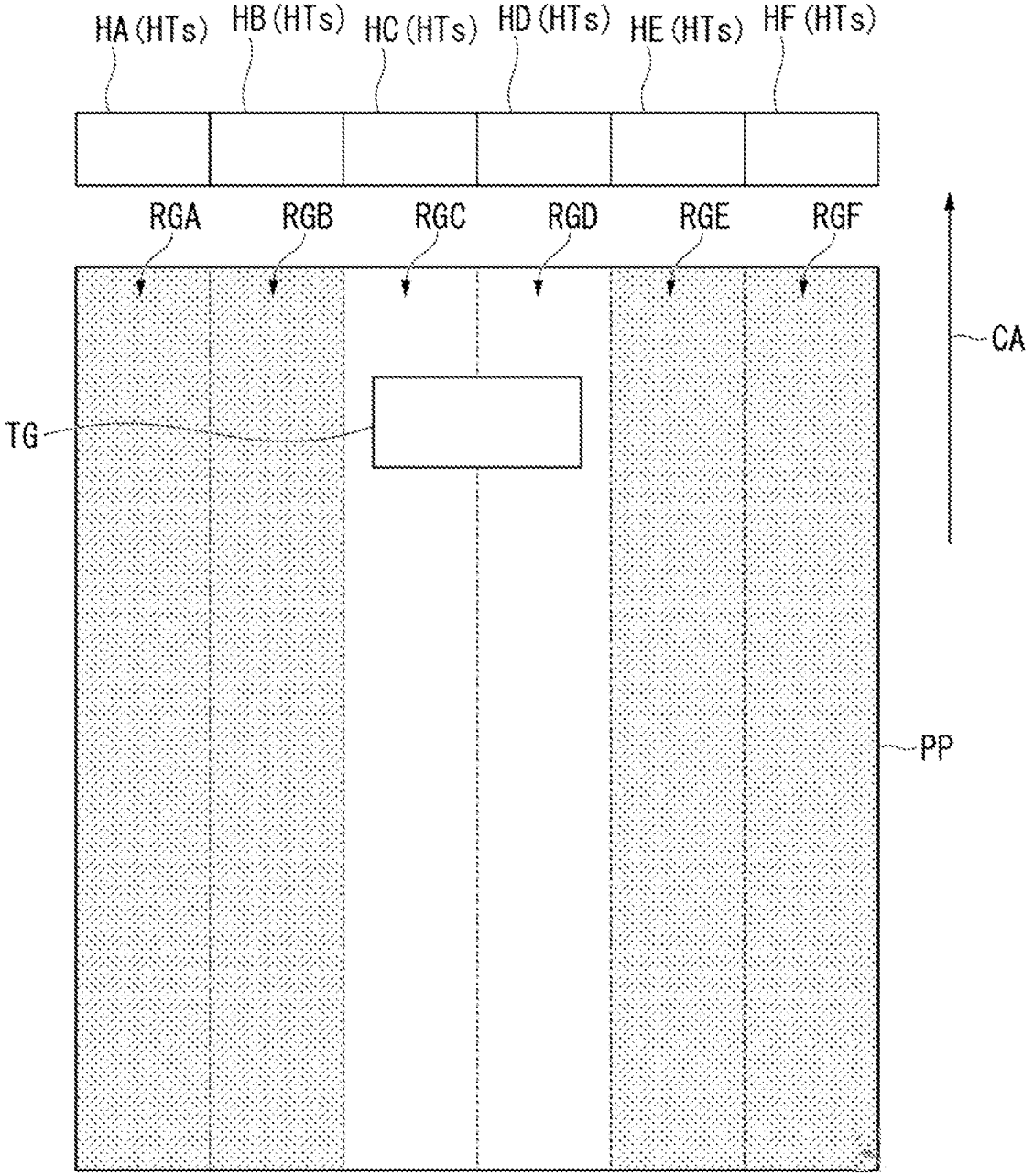
FIG. 2 is a diagram illustrating a relationship between a region on a print medium and a plurality of heat generating bodies included in a fixing device.

FIG. 2 is a diagram illustrating a relationship between the region on the print medium and the plurality of heat generating bodies included in the fixing device 114. The print medium PP illustrated in FIG. 2 is an example of the print medium having the wireless tag TG as described above. The direction indicated by an arrow CA illustrated in FIG. 2 indicates an example of the conveyance direction in which the print medium PP is conveyed in the image forming apparatus 1. In the example illustrated in FIG. 2, the region on the print medium PP is virtually divided into six division regions including a division region RGA, a division region RGB, a division region RGC, a division region RGD, a division region RGE, and a division region RGF. In this example, the fixing device 114 includes six heat generating bodies including a heat generating body HA, a heat generating body HB, a heat generating body HC, a heat generating body HD, a heat generating body HE, and a heat generating body HF as a plurality of heat generating bodies included in the heat generating body group HTs. The heat generating body HA is provided so as to be located on a path through which the division region RGA passes by conveying the print medium PP. Accordingly, the heat generating body HA is associated with the division region RGA, and the division region RGA can be heated. The heat generating body HB is provided so as to be located on a path through which the division region RGB passes by conveying the print medium PP. Accordingly, the heat generating body HB is associated with the division region RGB, and the division region RGB can be heated. The heat generating body HC is provided so as to be located on a path through which the division region RGC passes by conveying the print medium PP. Accordingly, the heat generating body HC is associated with the division region RGC, and the division region RGC can be heated. The heat generating body HD is provided so as to be located on a path through which the division region RGD passes by conveying the print medium PP. Accordingly, the heat generating body HD is associated with the division region RGD, and the division region RGD can be heated. The heat generating body HE is provided so as to be located on a path through which the division region RGE passes by conveying the print medium PP. Accordingly, the heat generating body HE is associated with the division region RGE, and the division region RGE can be heated. The heat generating body HF is provided so as to be located on a path through which the division region RGF passes by conveying the print medium PP. Accordingly, the heat generating body HF is associated with the division region RGF, and the division region RGF can be heated. As described above, in the example, the regions that can be heated by these six heat generating bodies among the regions on the print medium PP are divided into six division regions that are aligned parallel to each other in the direction perpendicular to the conveyance direction of the print medium PP. In this example, each of these six heat generating bodies is aligned in a direction perpendicular to the direction. However, these six heat generating bodies may be arranged to be aligned in different directions, may be arranged in a zigzag manner, or may be arranged by another arrangement method. The region that can be heated by these six heat generating bodies may be divided into six division regions that are aligned non-parallel to each other in the direction, or may be divided into six division regions that are aligned in a grid pattern, or may be divided into six division regions by another method. The fixing device 114 may be configured to have five or less heat generating bodies, or may be configured to have seven or more heat generating bodies instead of six heat generating bodies.

In the example illustrated in FIG. 2, the wireless tag TG is attached on the print medium PP so as to straddle the two division regions of the division region RGC and the division region RGD. In this case, the control unit 110 selects four division regions of the division region RGA, the division region RGB, the division region RGE, and the division region RGF, as the heating region described above. In this case, the control unit 110 selects the four heat generating bodies that heat the respective four division regions as one or more heat generating bodies to be heated among the six heat generating bodies. The four heat generating bodies are the heat generating body HA, the heat generating body HB, the heat generating body HE, and the heat generating body HF. In FIG. 2, these four division regions are illustrated as hatched regions among the regions on the print medium PP.

For the convenience of explanation, forming the toner image on the print medium and fixing the toner image as a target image on the print medium by heating the print medium will be referred to as printing.

Referring back to FIG. 1, the wireless tag communication device 13 includes an antenna 131 that transmits or radiates radio waves to a predetermined radiation region RA among the regions on the conveyance path through which the print medium passes by conveying by the image formation unit 113.

The antenna 131 is, for example, a single antenna that transmits or radiates radio waves to the radiation region RA. The antenna 131 may be configured with a plurality of antennas. A direction indicated by an arrow k in FIG. 1 indicates an example of the direction to which the antenna 131 radiates radio waves.

The wireless tag communication device 13 radiates radio waves to the antenna 131 according to the control of the control unit 110.

The wireless tag communication device 13 reads the position information indicating the position of each wireless tag on the print medium from each of the one or more wireless tags attached to the print medium having the wireless tag by radiating such radio waves. For example, the wireless tag communication device 13 reads the position information indicating the position of the wireless tag TG on the print medium PP from the wireless tag TG attached to the print medium PP by radiating such radio waves. The method of reading the position information from each wireless tag may be a known method or may be a method to be developed in the future. For this reason, the description of the method of reading the position information from each wireless tag will be omitted. The wireless tag communication device 13 is an example of a position information reading unit.

The wireless tag communication device 13 writes various tag information to each of one or more wireless tags attached to the print medium having the wireless tag by radiating such radio waves. For example, the wireless tag communication device 13 writes various tag information to the wireless tag TG attached to the print medium PP by radiating such radio waves. In other words, the wireless tag communication device 13 allows the wireless tag TG attached to the print medium PP to store various tag information by radiating such radio waves. The method of writing the tag information to each wireless tag may be a known method or may be a method to be developed in the future. For this reason, the description of the method of writing the tag information to each wireless tag will be omitted.

Configuration of Image Formation Unit

Hereinafter, the configuration of the image formation unit 113 will be described.

The image formation unit 113 includes an intermediate transfer belt 20. The image formation unit 113 includes a driven roller 21, a backup roller 22, a secondary transfer roller 23, two registration rollers 24, and a manual paper feed roller 25. The image formation unit 113 includes four sets of image formation stations including an image formation station 31, an image formation station 32, an image formation station 33, and an image formation station 34. The image formation unit 113 includes a double-sided printing device DF. The image formation unit 113 includes a print medium detection unit 40.

The intermediate transfer belt 20 is a belt on which the toner image is primarily transferred by the four sets of image formation stations. The intermediate transfer belt 20 is supported by the driven roller 21, the backup roller 22, and the like. The intermediate transfer belt 20 rotates in a direction indicated by arrow m of FIG. 1. More specifically, the image formation unit 113 rotates the intermediate transfer belt 20 in the direction with a motor (not illustrated) according to the control of the control unit 110.

The image formation station 31 is an image formation station for forming a Y (yellow) image. The image formation station 32 is an image formation station for forming an M (magenta) image. The image formation station 33 is an image formation station for forming a C (cyan) image. The image formation station 34 is an image formation station for forming a K (black) image. In the image formation unit 113, these four sets of image formation stations are arranged below the intermediate transfer belt 20 along the rotation direction of the intermediate transfer belt 20.

The image formation station 31 includes a photoreceptor drum 311, an electrostatic charger 312, an exposure scanning head 313, a developing device 314, a photoreceptor cleaner 315, and a primary transfer roller 316. In the image formation station 31, the electrostatic charger 312, the exposure scanning head 313, the developing device 314, the photoreceptor cleaner 315, and the primary transfer roller 316 are arranged around the photoreceptor drum 311 that rotates in the direction indicated by arrow n of FIG. 1. The primary transfer roller 316 faces the photoreceptor drum 311 via the intermediate transfer belt 20.

The configuration of each of the image formation station 32, the image formation station 33, and the image formation station 34 is the same as that of the image formation station 31. For this reason, in the following, description of configuration of each of the image formation station 32, the image formation station 33, and the image formation station 34 will be omitted.

The secondary transfer roller 23 faces the backup roller 22 via the intermediate transfer belt 20. The secondary transfer roller 23 secondarily transfers the toner image primarily transferred to the intermediate transfer belt 20 to the print medium passing between the secondary transfer roller 23 and the intermediate transfer belt 20.

The two registration rollers 24 convey the print medium picked up from each of the paper feed cassette 111, the paper feed cassette 112, and the manual feed tray TA by a conveyance mechanism (not illustrated) between the secondary transfer roller 23 and the intermediate transfer belt 20.

The manual paper feed roller 25 picks up the print medium from the manual feed tray TA and conveys the print medium to the two registration rollers 24.

The print medium after the toner image is secondarily transferred by the secondary transfer roller 23 is conveyed to the fixing device 114 that fixes the toner image formed on the print medium as the target image. The fixing device 114 fixes the toner image secondarily transferred to the print medium on the print medium as a target image while conveying the print medium by the rollers. Accordingly, the target image is formed on the print medium.

The double-sided printing device DF is a device that conveys the print medium after the target image is formed on the surface by the fixing device 114 to the two registration rollers 24. The print medium after the front surface and the back surface are turned inside out is conveyed to the double-sided printing device DF. For this reason, the target image is formed via the secondary transfer roller 23 and the fixing device 114 on the back surface of the print medium conveyed between the two registration rollers 24 via the double-sided printing device DF.

The print medium detection unit 40 detects the front end of the print medium to be conveyed. For example, the print medium detection unit 40 is an optical sensor. The print medium detection unit 40 may be another sensor such as a contact sensor as long as the sensor can detect the front end of the print medium to be conveyed. The print medium detection unit 40 is provided at a position where the front end of the print medium passing through the position ahead of the radiation region RA can be detected among the positions on the conveyance path where the print medium is conveyed. When the print medium detection unit 40 detects the front end, the print medium detection unit 40 outputs information indicating that the front end is detected to the control unit 110.

Operation of Image Formation Unit

The operation of the image formation unit 113 will be described below.

First, the operation of the four sets of image formation stations will be described by exemplifying the operation of the image formation station 31.

The image formation station 31 charges the photoreceptor drum 311 with the electrostatic charger 312 and then exposes the photoreceptor drum 311 with the exposure scanning head 313. Accordingly, the image formation station 31 forms an electrostatic latent image on the photoreceptor drum 311. After that, the image formation station 31 allows the developing device 314 to develop the electrostatic latent image on the photoreceptor drum 311. The developing device 314 develops the electrostatic latent image on the photoreceptor drum 311 as a toner image by using a two-component developer formed by the toner and the carrier. The primary transfer roller 316 primarily transfers the toner image formed on the photoreceptor drum 311 to the intermediate transfer belt 20 in this method. After this primary transfer is performed, the photoreceptor cleaner 315 removes the toner remaining on the photoreceptor drum 311.

Each of the image formation station 31, the image formation station 32, the image formation station 33, and the image formation station 34 forms a color toner image on the intermediate transfer belt 20 by the primary transfer roller 316. The color toner image is formed by sequentially superimposing Y (yellow), M (magenta), C (cyan), and K (black) toner images.

Next, the operation of the secondary transfer roller 23 will be described. The secondary transfer roller 23 collectively transfers the color toner image on the intermediate transfer belt 20 to the print medium passing between the secondary transfer roller 23 and the intermediate transfer belt 20. In the following description, the term "toner image" may be either a color toner image or a toner image of only one color. The toner image may be a toner image using a decolorable toner.

Next, among the operations of the image formation unit 113, the operation of conveying the print medium will be described.

The print media picked up from the paper feed cassette 111, the paper feed cassette 112, and the manual feed tray TA are bent in the nip of the two registration rollers 24 by the conveyance mechanism (not illustrated). Accordingly, the front end of the print medium is position-aligned. After that, the two registration rollers 24 convey the print medium between the secondary transfer roller 23 and the intermediate transfer belt 20 according to the timing at which the image formation unit 113 transfers the toner image to the print medium. The conveyance paths for conveying the print media picked up from the paper feed cassette 111, the paper feed cassette 112, and the manual feed tray TA to the two registration rollers 24 merge at a confluence portion PA illustrated in FIG. 1.

In the image formation unit 113, three conveyance paths of a conveyance path LA, a conveyance path LB, and a conveyance path LC are formed by the two registration rollers 24, the fixing device 114, and the plurality of rollers in the double-sided printing device DF. The conveyance path LA is a conveyance path from the confluence portion PA to a branch portion PB illustrated in FIG. 1. The conveyance path LB is a conveyance path that passes through the double-sided printing device DF and is a conveyance path from the branch portion PB to the confluence portion PA. The conveyance path LC is a conveyance path from the branch portion PB to the paper ejection tray TB.

The two registration rollers 24 start rotating in accordance with the position of the toner image of the rotating intermediate transfer belt 20 and move the print medium to the position of the secondary transfer roller 23. Accordingly, the toner image formed on the intermediate transfer belt 20 is secondarily transferred to the print medium by the secondary transfer roller 23. After the toner image is secondarily transferred to the print medium, the secondary transfer roller 23 conveys the print medium to the fixing device 114 along the conveyance path LA. The fixing device 114 fixes the toner image secondarily transferred to the print medium conveyed from the secondary transfer roller 23 to the print medium while conveying the print medium. Accordingly, the toner image that is secondarily transferred is formed as an image on the print medium. The fixing device 114 conveys the print medium to the conveyance path LC after the image is formed on the print medium. Then, the print medium conveyed to the conveyance path LC is ejected by a roller (not illustrated).

In the case of double-sided printing, after the entire print medium passes through the branch portion PB since the image was formed on the front surface, a roller (not illustrated) conveys the print medium to the conveyance path LB by switchback. Accordingly, the front surface and the back surface of the print medium are turned inside out. After that, the plurality of rollers in the double-sided printing device DF convey the print medium to the nips of the two registration rollers 24 along the conveyance path LB. Then, the print medium of which front surface and back surface are turned inside out is conveyed along the conveyance path LA via the two registration rollers 24, and the toner image is fixed as the target image by the fixing device 114. Accordingly, the target image is formed on the back surface of the print medium. The fixing device 114 conveys the print medium, of which the back surface the target image is formed on, to the conveyance path LC and ejects the paper. The target image formed on the front surface of the print medium and the target image formed on the back surface of the print medium may be different images or may be the same image.

As described above, the secondary transfer roller 23, the two registration rollers 24, the fixing device 114, and the various rollers in the double-sided printing device DF constitute a conveying unit H (a conveyor assembly) that conveys the print medium in the image forming apparatus 1.

Functional Configuration of Control Unit

Figure 3:
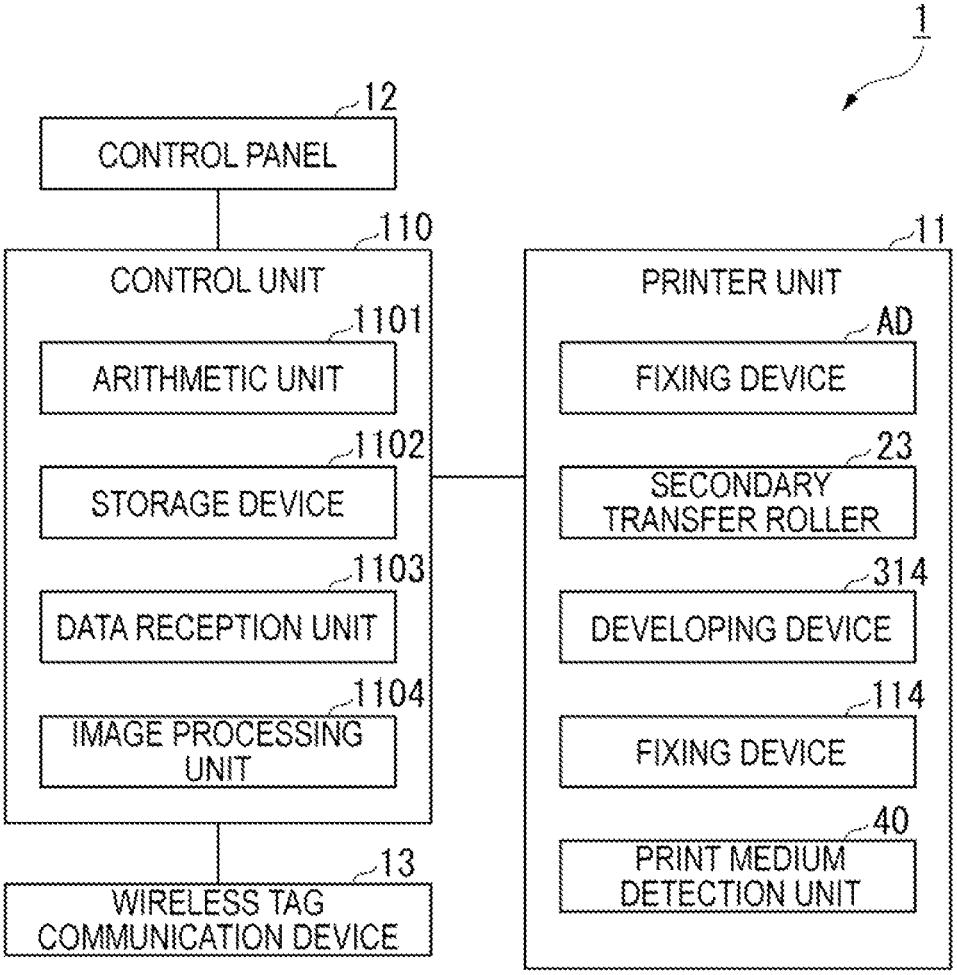
FIG. 3 is a diagram illustrating an example of a functional configuration of a control unit of the image forming apparatus.

Next, a functional configuration of the control unit 110 will be described with reference to FIG. 3. FIG. 3 is a diagram illustrating an example of the functional configuration of the control unit 110.

As illustrated in FIG. 3, the control unit 110 is communicably connected to each of the printer unit 11, the control panel 12, and the wireless tag communication device 13. The control unit 110 includes an arithmetic unit 1101 (a processing circuit), a storage device 1102 (a memory), a data reception unit 1103 (a receiver, a communications interface, etc.), and an image processing unit 1104 (a processor).

The arithmetic unit 1101 is, for example, a central processing unit (CPU), an application specific integrated circuit (ASIC), or the like. The arithmetic unit 1101 controls each of the printer unit 11, the control panel 12, and the wireless tag communication device 13 according to an image processing program stored in the storage device 1102.

The storage device 1102 is a read only memory (ROM), a random access memory (RAM), a hard disk drive (HDD), a solid state drive (SSD), or the like. The storage device 1102 may be separate from the control unit 110.

The data reception unit 1103 receives print data (for example, data described in a page description language) indicating the target image to be printed from a host such as a personal computer (PC) and stores the received print data in the storage device 1102.

The image processing unit 1104 performs various image processes performed by the image forming apparatus 1. For example, the image processing unit 1104 determines print conditions from the print data stored in the storage device 1102 by the data reception unit 1103, and thus, loads the print data into data (for example, raster data) that can be printed by the printer unit 11 and stores the print data in the storage device 1102.

Figure 4:
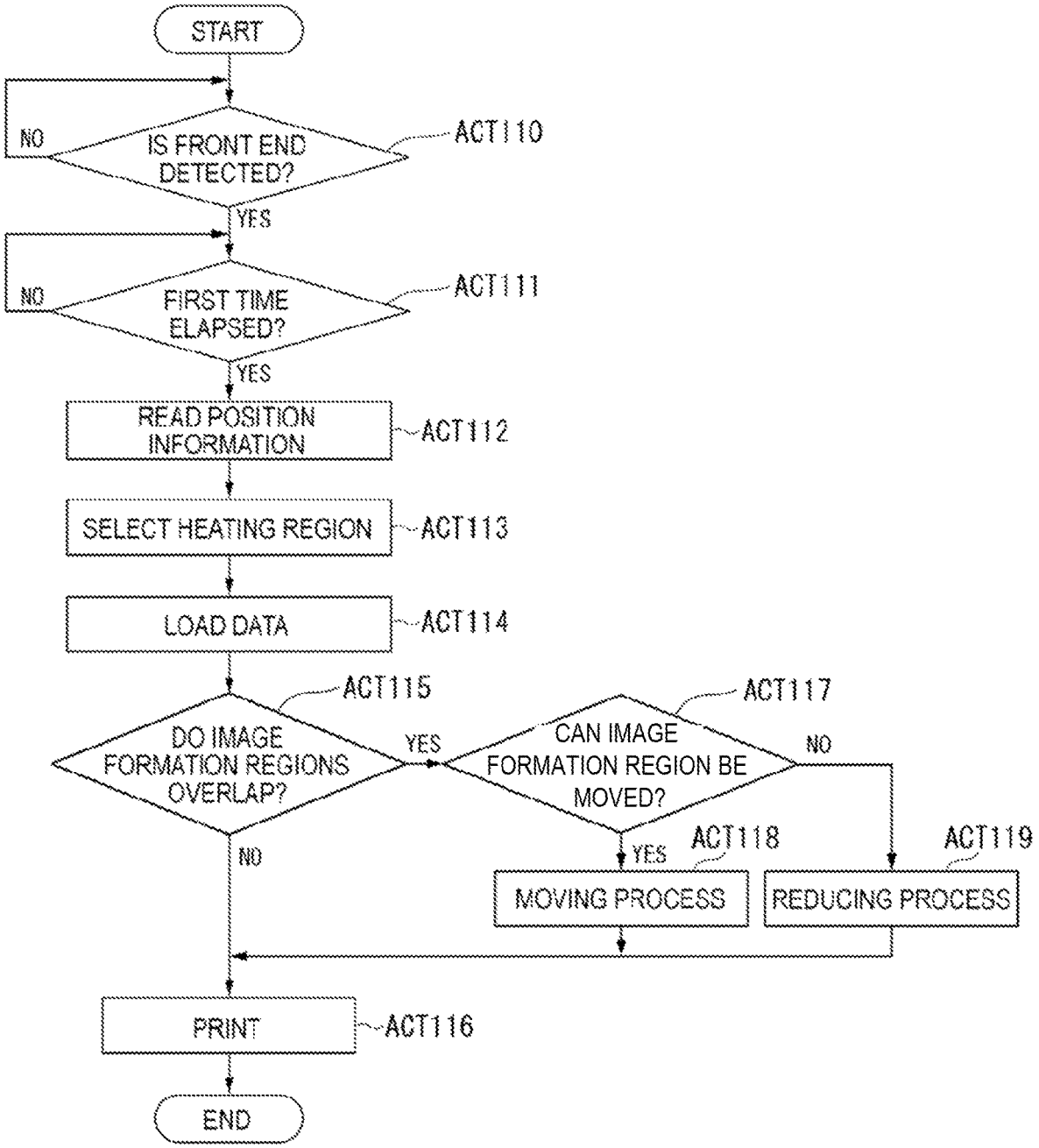
FIG. 4 is a diagram illustrating an example of a processing flow in which the image forming apparatus forms an image on a print medium having a wireless tag.

Process of Forming Image on Print Medium Having Wireless Tag by Image Forming Apparatus A process of forming an image on a print medium having a wireless tag by the image forming apparatus 1 will be described with reference to FIG. 4. FIG. 4 is a diagram illustrating an example of a processing flow in which the image forming apparatus 1 forms an image on the print medium having the wireless tag. As an example, a case where the image forming apparatus 1 forms the target image PG on the print medium PP will be described. As an example, a case where the print data is stored in the storage device 1102 by the data reception unit 1103 at the timing before the process of ACT110 illustrated in FIG. 4 is performed will be described. The print data is print data indicating the target image PG. As an example, a case where the image forming apparatus 1 receives an operation of starting the process of forming the target image PG on the print medium PP at the timing will be described. As an example, a case where the conveying of the print medium PP by the image forming apparatus 1 is started at the timing will be described.

The control unit 110 waits until the front end of the print medium PP is detected by the print medium detection unit 40 (ACT110). When the control unit 110 acquires information indicating that the front end is detected from the print medium detection unit 40, the control unit 110 determines that the front end of the print medium PP is detected by the print medium detection unit 40. On the other hand, when the control unit 110 does not acquire the information indicating that the front end is detected from the print medium detection unit 40, the control unit 110 determines that the front end of the print medium PP is not detected by the print medium detection unit 40.

When the control unit 110 determines that the front end of the print medium PP is detected by the print medium detection unit 40 (YES in ACT110), the control unit 110 proceeds to ACT111. That is, in this case, the control unit 110 waits until a predetermined first time elapses from the timing when the print medium detection unit 40 determines that the front end of the print medium PP is detected in ACT110 (ACT111). The first time is a time required from detecting the front end of the print medium PP to a timing when the front end enters the radiation region RA. The first time may be determined by tests, experiments, or the like performed in advance or may be calculated based on a theoretical formula.

When the control unit 110 determines in ACT111 that the first time elapses (YES in ACT111), the control unit 110 proceeds to ACT112. That is, in this case, the control unit 110 controls the wireless tag communication device 13 and reads the position information indicating the position of the wireless tag TG on the print medium PP from the wireless tag TG attached to the print medium PP (ACT112).

Next, the control unit 110 selects the heating region to be heated by the fixing device 114 based on the position information read in ACT112 (ACT113). Specifically, in ACT113, the control unit 110 selects the region that does not include the position of the wireless tag TG among the regions on the print medium PP as the heating region based on the position information. For example, the position information may be coordinates indicating the positions of the plurality of points included within the contour or perimeter of the wireless tag TG on the print medium PP or may be other information indicating the positions in the region on the print medium PP. For example, the control unit 110 selects the heating region based on the coordinates and first information. The first information is information indicating which of the six division regions on the print medium PP the coordinates indicating the positions on the print medium PP are included. In this case, the first information is stored in the storage device 1102 in advance. In this case, the control unit 110 selects one or more division regions that do not include the coordinates indicated by the position information among the six division regions as the heating region. It should be noted that the method of selecting the heating region may be another method based on the position information instead of this method.

Next, the control unit 110 loads the print data stored in advance in the storage device 1102 into data (for example, raster data or the like) that can be printed by the printer unit 11 (ACT114). As an example, a case where the control unit 110 loads the print data into the raster data in ACT114 will be described.

The process of ACT113 and the process of ACT114 may be performed in the reverse order or may be performed in parallel.

Next, the control unit 110 performs a process of ACT115 based on the position information read in ACT112 and the raster data loaded in ACT114. That is, the control unit 110 determines whether or not the image formation region and the non-heating region overlap each other based on the position information and the raster data (ACT115). The image formation region is a region on the print medium PP on which the target image PG is formed by the image formation unit 113. The non-heating region is a region on the print medium PP other than the heating region selected in ACT113. Each pixel on the raster data is associated with a position on the print medium PP. For this reason, the control unit 110 can specify each of the image formation region and the non-heating region by scanning the raster data. For example, the control unit 110 scans the raster data based on second information to specify the image formation region and the non-heating region. The second information is information indicating which of the six division regions on the print medium PP the position on the print medium PP is included in among the positions associated with the pixels on the raster data. In this case, the second information is stored in the storage device 1102 in advance. The method of specifying the image formation region and the non-heating region by scanning the raster data may be a known method or may be a method to be developed in the future. After specifying both the image formation region and the non-heating region, the control unit 110 determines whether or not the specified image formation region and the specified non-heating region overlap each other. For example, when the non-heating region is the division region RGC and the division region RGD illustrated in FIG. 2, the control unit 110 determines whether or not the image formation region overlaps the division region RGC and the division region RGD.

Figure 5:
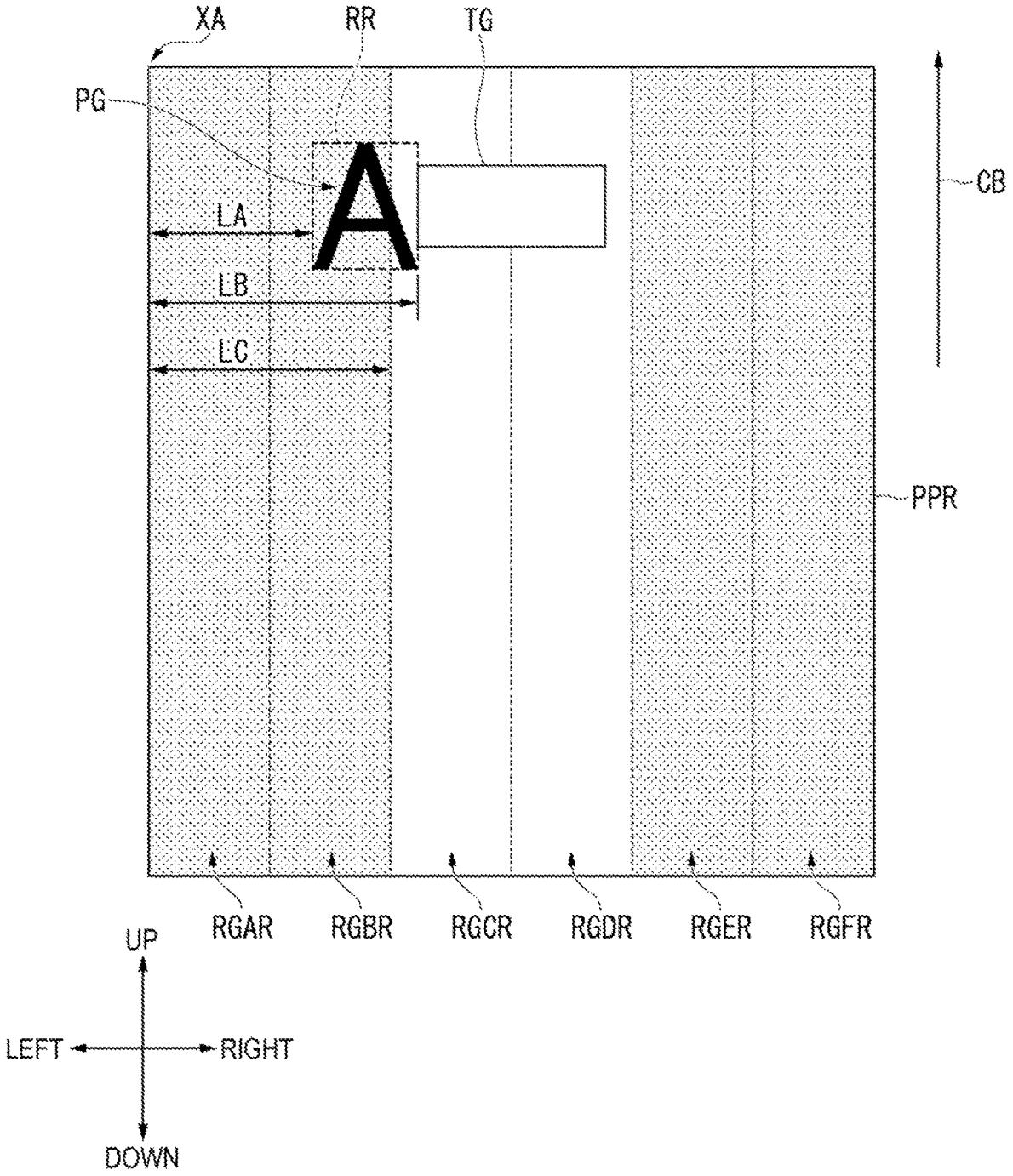
FIG. 5 is an image diagram of loaded raster data.

FIG. 5 is an image diagram of the loaded raster data. The data PPR illustrated in FIG. 5 is an example of the image diagram. In FIG. 5, the up, down, left, and right on the data PPR are indicated by arrows illustrated in FIG. 5. A direction indicated by arrow CB illustrated in FIG. 5 is an example of the direction on the data PPR that corresponds to the conveyance direction of the print medium PP. A region RGAR on the data PPR is the region corresponding to the division region RGA on the print medium PP. A region RGBR of the data PPR is the region corresponding to the division region RGB on the print medium PP. A region RGCR of the data PPR is the region corresponding to the division region RGC on the print medium PP. A region RGDR of the data PPR is the region corresponding to the division region RGD on the print medium PP. A region RGER of the data PPR is the region corresponding to the division region RGE on the print medium PP. A region RGFR of the data PPR is the region corresponding to the division region RGF on the print medium PP. The unhatched region illustrated in FIG. 5 is an example of the region corresponding to the non-heating region on the data PPR. The hatched region illustrated in FIG. 5 is an example of the region corresponding to a heating region in the data PPR. A region RR surrounded by the dotted line illustrated in FIG. 5 is an example of the region corresponding to the image formation region on the data PPR. The target image PG is included in the region RR.

For example, the control unit 110 scans the data PPR based on the second information in ACT115 to specify the region corresponding to the region RR among the regions on the print medium PP as the image formation region and also to specify the region corresponding to each of the region RGCR and the region RGDR among the regions on the print medium PP as the non-heating region. The control unit 110 determines whether or not the specified image formation region and the specified non-heating region overlap each other. In the example illustrated in FIG. 5, since the region RR overlaps the region RGCR, the control unit 110 determines that the image formation region and the non-heating region overlap each other. In ACT115, the specification of the image formation region and the non-heating region and the determination of whether or not the image formation region and the non-heating region overlap may be performed in parallel.

When the control unit 110 determines that the image formation region and the non-heating region do not overlap each other (NO in ACT115), the control unit 110 prints the target image PG on the print medium PP (ACT116) and ends the process of the flowchart illustrated in FIG. 4.

On the other hand, when the control unit 110 determines that the image formation region and the non-heating region overlap each other (YES in ACT115), the control unit 110 proceeds to ACT117. That is, in this case, the control unit 110 determines whether or not the image formation region will protrude from the print medium PP if the overlap between the image formation region and the non-heating region is eliminated by moving the image formation region in a predetermined moving direction (ACT117). In FIG. 4, the process of ACT117 is illustrated as "can image formation region be moved?". The predetermined moving direction is, for example, a direction perpendicular to the conveyance direction of the print medium PP, but may be another direction intersecting the conveyance direction. The direction is sometimes referred to as a main scanning direction.

The process of ACT117 will be described again with reference to FIG. 5. The control unit 110 scans the raster data and specifies the end of both ends of the print medium PP in the main scanning direction, which is closer to the region RR specified in ACT115, as a first end. The end XA illustrated in FIG. 5 is an example of the first end. The control unit 110 specifies the direction from the region RR to the end XA as the moving direction out of the two directions parallel to the main scanning direction. The control unit 110 calculates the shortest distance between the end XA and the region RR, which is a distance in the main scanning direction. The control unit 110 calculates the longest distance between the end XA and the region RR, which is a distance in the main scanning direction. The control unit 110 calculates the shortest distance between the end XA and the non-heating region, which is a distance in the main scanning direction. The shortest distance in the main scanning direction between the first end and the non-heating region is, in the example illustrated in FIG. 5, the shortest distance in the main scanning direction among the distances between the first end and the region RGCR. The distance LA illustrated in FIG. 5 is an example of the shortest distance in the main scanning direction among the distances between the end XA and the region RR. The distance LB illustrated in FIG. 5 is an example of the longest distance in the main scanning direction among the distances between the end XA and the region RR. The distance LC illustrated in FIG. 5 is an example of the shortest distance in the main scanning direction among the distances between the end XA and the region RGCR. When the difference distance between the distance LB and the distance LC is larger than the distance LA, if the overlap between the image formation region and the non-heating region is eliminated by moving the image formation region in the specified moving direction, the control unit 110 determines that the image formation region protrudes from the print medium PP. On the other hand, when the difference distance between the distance LB and the distance LC is equal to or smaller than the distance LA, even though the overlap between the image formation region and the non-heating region is eliminated by moving the image formation region in the specified moving direction, the control unit 110 determines that the image formation region does not protrude from the print medium PP. It should be noted that the method of calculating each of the distance LA, the distance LB, and the distance LC may be a known method or may be a method to be developed in the future.

When the control unit 110 determines that the image formation region does not protrude from the print medium PP even though the overlap between the image formation region and the non-heating region is eliminated by moving the image formation region in the moving direction (YES in ACT117), the control unit 110 proceeds to ACT118. That is, in this case, the control unit 110 performs the moving process as an image process of eliminating the overlap between the image formation region and the non-heating region (ACT118). The moving process is a process of moving the image formation region relative to the non-heating region in the moving direction by editing the raster data.

Figure 6:
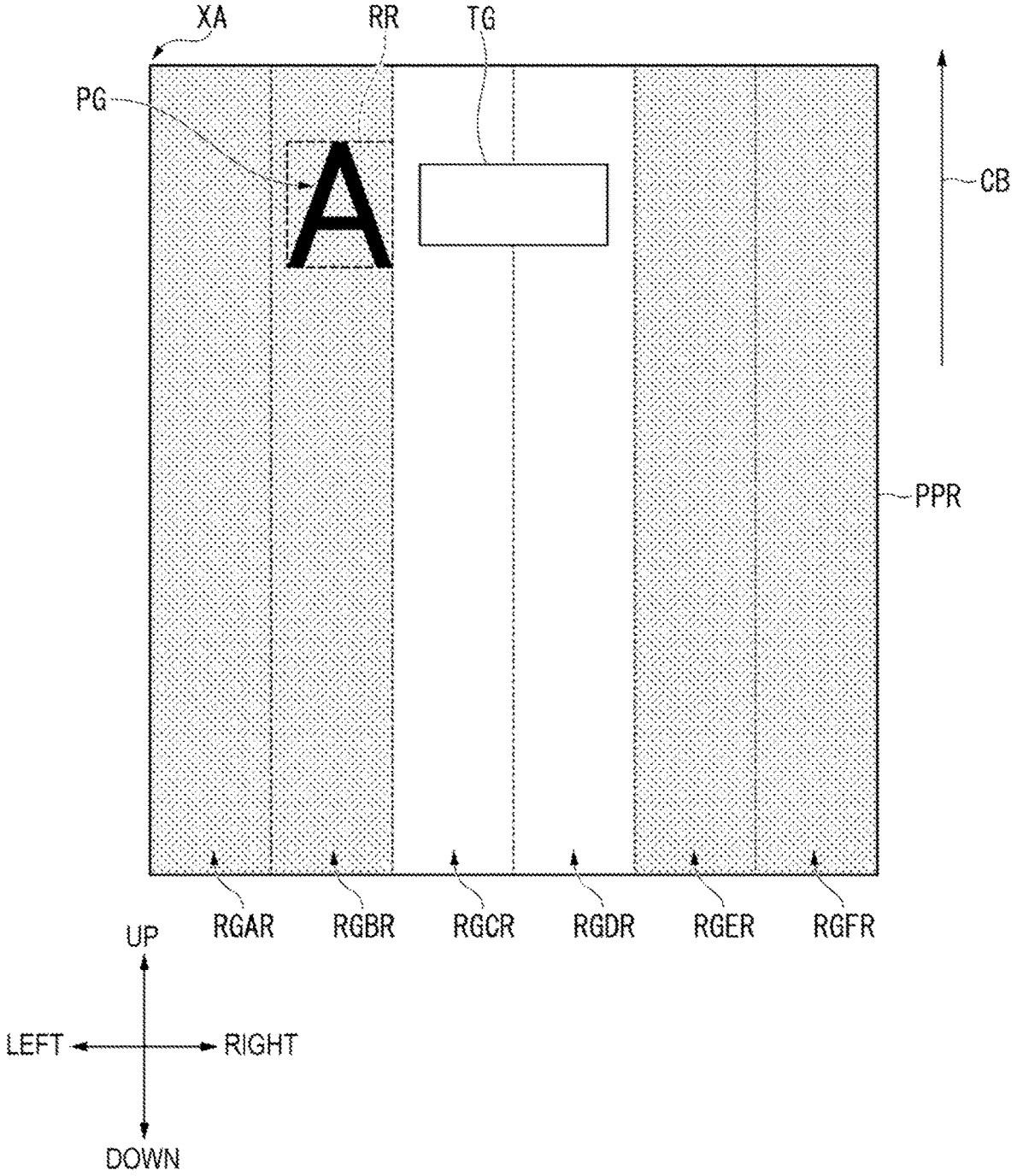
FIG. 6 is an image diagram illustrating an example of a state after moving a region illustrated in FIG. 5 relative to a non-heating region by a moving process.

FIG. 6 is an image diagram illustrating an example of the state after moving the region RR illustrated in FIG. 5 relative to the non-heating region by the moving process. As compared with FIG. 5, the region RR in FIG. 6 is moved relative to the non-heating region in the moving direction parallel to the main scanning direction. Accordingly, the control unit 110 can prevent the wireless tag TG from being defective due to the heating of the wireless tag TG without losing the target image PG formed on the print medium PP. In the example illustrated in FIG. 6, the control unit 110 uses the difference distance between the distance LB and the distance LC as the distance for moving the region RR in the moving direction. The control unit 110 may be configured to use any distance as the distance for moving the region RR in the moving direction as long as the distance is shorter than the distance LA.

After the process of ACT118 is performed, the control unit 110 proceeds to ACT116 and forms the toner image of the target image PG on the print medium PP in the image formation unit 113 based on the raster data after performing the moving process. Then, the control unit 110 heats one or more heat generating bodies corresponding to the heating region selected from among the six heat generating bodies included in the fixing device 114 to the fixing device 114 and fixes the toner image as the target image PG on the print medium PP. In this manner, the control unit 110 prints the target image PG on the print medium PP and ends the processes of the flowchart illustrated in FIG. 4.

On the other hand, when the control unit 110 determines that the image formation region protrudes from the print medium PP if the overlap between the image formation region and the non-heating region is eliminated by moving the image formation region in the moving direction (NO in ACT117), the control unit 110 proceeds to ACT119. That is, in this case, the control unit 110 performs a reducing process as an image process of eliminating the overlap between the image formation region and the non-heating region (ACT119). The reducing process is a process of reducing the image formation region with respect to the non-heating region by editing the raster data.

Figure 7:
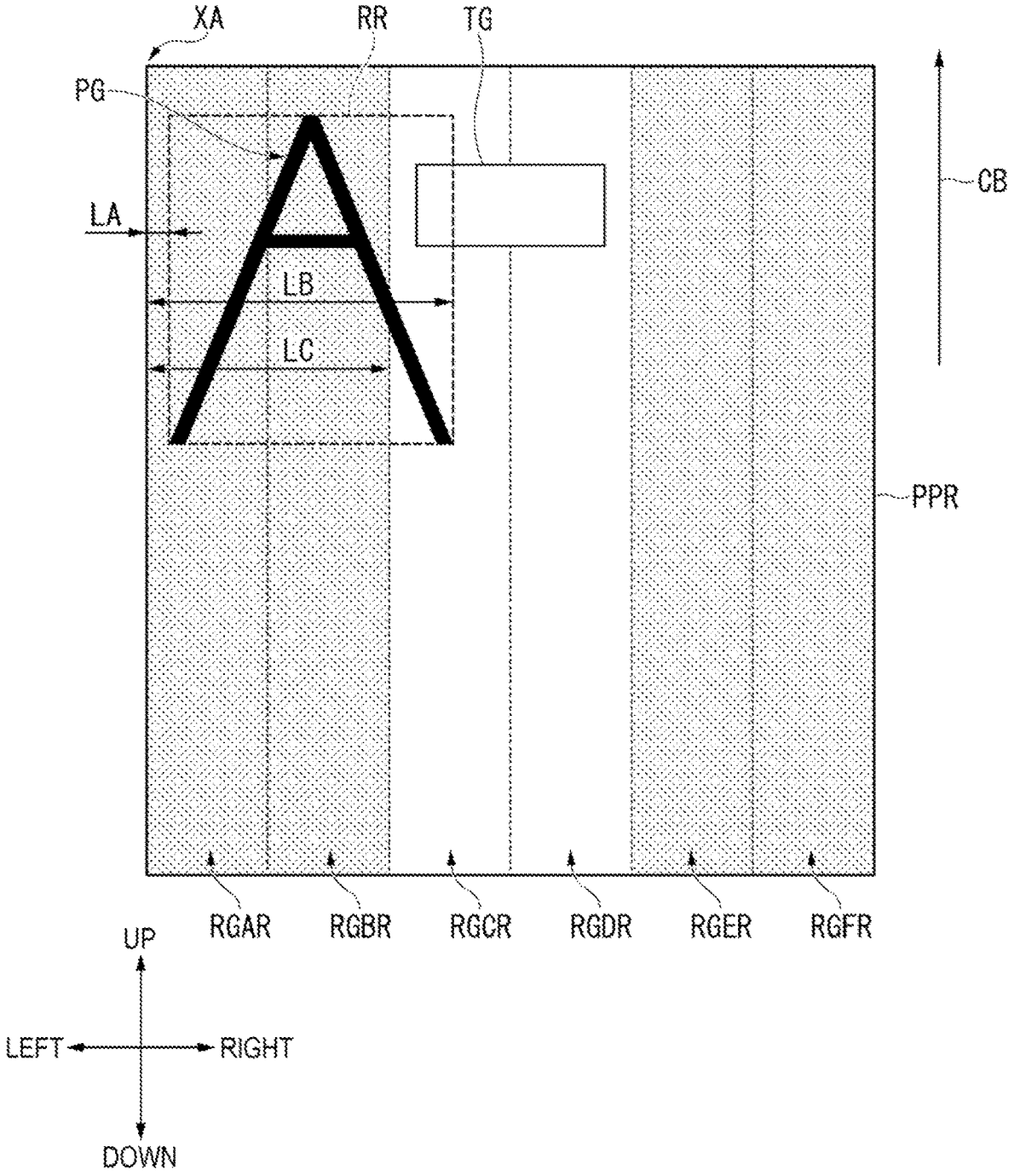
FIG. 7 is a diagram illustrating an example of raster data when an image formation region protrudes from the print medium when overlap between the image formation region and the non-heating region is eliminated by moving the image formation region in the moving direction.

FIG. 7 is a diagram illustrating an example of the raster data in which the image formation region protrudes from the print medium PP if the overlap between the image formation region and the non-heating region is eliminated by moving the image formation region in the moving direction. In the example illustrated in FIG. 7, the difference distance between the distance LB and the distance LC is larger than the distance LA. In this case, if the overlap between the region RR and the non-heating region is eliminated by moving the region RR in the moving direction, the image formation region protrudes from the print medium PP. Therefore, as illustrated in FIG. 8, the control unit 110 reduces the region RR with respect to the non-heating region by the reducing process.

Figure 8:
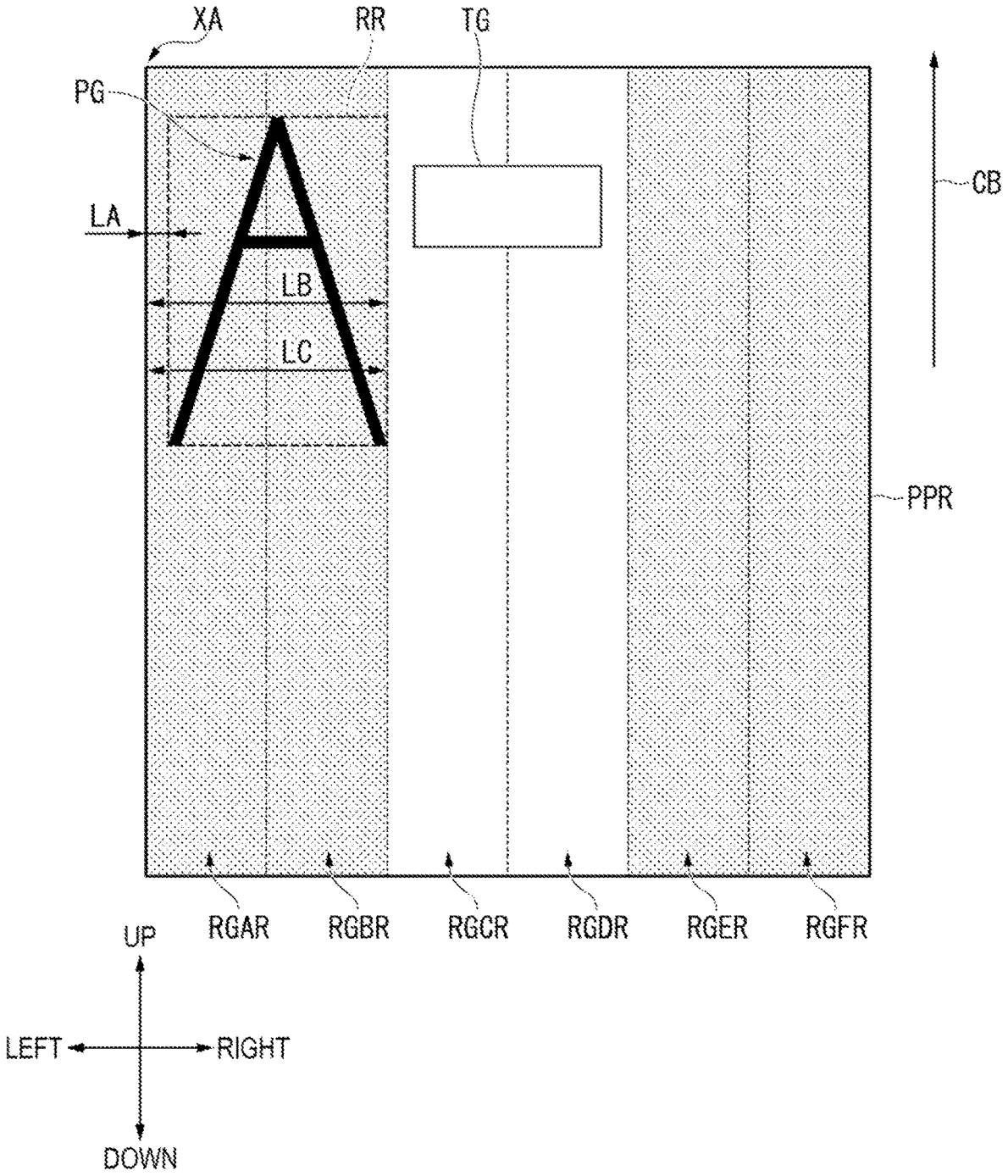
FIG. 8 is an image diagram illustrating an example of a state after the region illustrated in FIG. 7 is reduced with respect to the non-heating region by a reducing process.

FIG. 8 is an image diagram illustrating an example of the state after the region RR illustrated in FIG. 7 is reduced with respect to the non-heating region by the reducing process. As compared with FIG. 7, in FIG. 8, the length of the region RR in the main scanning direction is smaller than that in the non-heating region. In the example illustrated in FIG. 8, the control unit 110 uses the reduction ratio so that the distance LB is equal to or smaller than the distance LC as a reduction ratio for reducing the region RR. The control unit 110 calculates such a reduction ratio in the reducing process. For example, the control unit 110 calculates a reduction ratio at which the distance LB and the distance LC match each other as the reduction ratio for reducing the region RR. Then, the control unit 110 reduces the region RR by using the calculated reduction ratio in the reducing process. At this time, the control unit 110 reduces the region RR so that the distance between the end which is closer to the end XA out of both ends of the region RR in the main scanning direction and the end XA does not change. Accordingly, the control unit 110 can prevent the wireless tag TG from being defective due to the heating of the wireless tag TG without losing the target image PG formed on the print medium PP.

After the process of ACT119 is performed, the control unit 110 proceeds to ACT116 and forms the toner image of the target image PG on the print medium PP in the image formation unit 113 based on the raster data after performing the reducing process. Then, the control unit 110 heats one or more heat generating bodies corresponding to the heating region selected from among the six heat generating bodies included in the fixing device 114 to the fixing device 114 and fixes the toner image as the target image PG on the print medium PP. In this manner, the control unit 110 prints the target image PG on the print medium PP and ends the processes of the flowchart illustrated in FIG. 4.

At least one of the moving process and the reducing process described above may be configured to include a process of rotating the image formation region with respect to the non-heating region. One of the moving process and the reducing process described above may be replaced with the process of rotating the image formation region with respect to the non-heating region in the flowchart illustrated in FIG. 4.

The control unit 110 described above may be configured to allow the display unit of the control panel 12 to display the raster data after performing the image process of at least one of the moving process and the reducing process. Accordingly, the image forming apparatus 1 can allow the user to confirm the appearance when the target image PG after performing the image process is formed on the print medium PP. In this case, the control unit 110 may determine whether or not to perform the image process according to the operation received from the user. In this case, when the control unit 110 receives the operation indicating that the image process is not performed from the user, the control unit 110 proceeds to ACT116 and performs printing based on the raster data in which the image process is not performed.

The control unit 110 described above may be configured to perform the reducing process together with the moving process in ACT118. In ACT118, the control unit 110 described above may be configured to perform an image process other than reducing process among the image processes of eliminating the overlap between the image formation region and the non-heating region instead of moving process.

The control unit 110 described above may be configured to perform the moving process together with the reducing process in ACT119. In ACT119, the control unit 110 described above may be configured to perform an image process other than the moving process among the image processes of eliminating the overlap between the image formation region and the non-heating region instead of the reducing process.

As described above, the image forming apparatus (image forming apparatus 1 in the example described above) according to the embodiment includes a conveying unit (conveying unit H in the example described above), a position information reading unit (wireless tag communication device 13 in the example described above), an image formation unit (image formation unit 113 in the example described above), a fixing unit (fixing device 114 in the example described above), and a control unit (control unit 110 in the example described above). The conveying unit conveys a print medium (print medium PP in the example described above) to which one or more wireless tags (wireless tag TG in the example described above) are attached. The position information reading unit reads the position information indicating the position of each wireless tag on the print medium from each of the one or more wireless tags. The image formation unit forms a toner image of the target image on the print medium. The fixing unit includes, as a plurality of heat generating bodies associated with the respective different regions on the print medium (in the example described above, the heat generating body group HTs, the heat generating body HA, the heat generating body HB, the heat generating body HC, the heat generating body HD, the heat generating body HE, and the heat generating body HF), a plurality of heat generating bodies that heat the print medium and fixes the toner image formed on the print medium as the target image to the print medium by heating the print medium by at least a portion of the plurality of heat generating bodies. Based on the position information read by the position information reading unit, the control unit selects the region that does not include the position of each of one or more wireless tags as a heating region for being heated by the fixing unit from among the regions on the print medium, and when the image formation region in which the target image is formed by the image formation unit in the region on the print medium and the non-heating region that is not selected as the heating region among the regions on the print medium overlap each other, the control unit performs an image process of eliminating the overlap between the image formation region and the non-heating region on the target image, after that, allows the image formation unit to form the toner image of the target image after the performing of the image process on the print medium, and then, allows the fixing unit to heat one or more heat generating bodies corresponding to the heating regions selected among the plurality of heat generating bodies to fix the toner image as the target image on the print medium. Accordingly, the image forming apparatus can prevent the wireless tag from being defective due to the heating of the wireless tag without losing the target image formed on the print medium.

In the image forming apparatus, a configuration may be used in which the image process includes a moving process of moving the image formation region relative to the non-heating region.

In the image forming apparatus, a configuration may be used in which the control unit moves the image formation region in the moving direction intersecting the conveyance direction of the print medium in the moving process.

In the image forming apparatus, a configuration may be used in which the control unit performs the moving process when the image formation region does not protrude from the print medium even though the overlap between the image formation region and the non-heating region is eliminated by moving the image formation region in the moving direction.

In the image forming apparatus, a configuration may be used in which the moving direction is a direction perpendicular to the conveyance direction.

In the image forming apparatus, a configuration may be used in which the image process includes a reducing process of reducing the image formation region with respect to the non-heating region.

In the image forming apparatus, a configuration may be used in which the control unit performs the reducing process when the image formation region protrudes from the print medium if the overlap between the image formation region and the non-heating region is eliminated by moving the image formation region in the moving direction intersecting the conveyance direction of the print medium.

In the image forming apparatus, a configuration may be used in which the moving direction is a direction perpendicular to the conveyance direction.

A configuration may be used in which the image forming apparatus further includes a print medium detection unit that detects the front end of the print medium conveyed by the conveying unit, and the control unit allows the position information reading unit to read the position information when the first time elapses since the front end was detected by the print medium detection unit.

In the image forming apparatus, a configuration may be used in which the regions that can be heated by the plurality of heat generating bodies among the regions on the print medium are divided into a plurality of regions that are aligned parallel to each other in the direction perpendicular to the conveyance direction of the print medium, and the control unit selects a portion of the plurality of regions as the heating region based on the position information read by the position information reading unit.

Although some embodiments of the invention have been described, these embodiments are presented as examples and are not intended to limit the scope of the invention. These embodiments can be implemented in various other forms, and various omissions, replacements, and changes can be made without departing from the spirit of the invention. These embodiments and modifications thereof are included in the scope of the invention described in the claims and the scope of equivalents thereof similarly in the scope and spirit of the invention.

A program for realizing the functions of any components in the apparatus (for example, the image forming apparatus 1) described above may be recorded on a computer-readable recording medium, and the program may be read into a computer system to be executed. It should be noted that the term "computer system" as used herein includes hardware such as an operating system (OS) and peripheral devices. In addition, the "computer-readable recording medium" refers to a portable medium such as a flexible disk, a magneto-optical disk, a ROM, or a compact disk (CD)-ROM or a storage device such as a hard disk embedded in a computer system. Furthermore, the "computer-readable recording medium" includes those that store a program for a certain period of time such as a volatile memory (RAM) inside a computer system that serves as a server or client when the program is transmitted via a network such as the Internet or a communication channel such as a telephone line.

The above-described program may be transmitted from a computer system in which this program is stored in a storage device or the like to another computer system via a transmission medium or by a transmission wave in the transmission medium. Herein, the "transmission medium" for transmitting a program refers to a medium having a function of transmitting information, such as a network (communication network) of the Internet or the like and such as a communication channel (communication line) of a telephone line or the like.

In addition, the above-described program may be for realizing a portion of the above-mentioned functions. Furthermore, the above-described program may be a so-called difference file (difference program) that can realize the above-mentioned functions in combination with a program already recorded in the computer system.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a conveyor assembly configured to convey a print medium having a wireless tag attached thereto;

a reader configured to acquire position information indicating a position of the wireless tag on the print medium;

an image forming assembly configured to apply a toner image of a target image on the print medium based on print information;

a fixing device including a plurality of heating elements, one or more of the plurality of heating elements being associated with a respective region of a plurality of regions of the print medium and configured to heat the respective region of the print medium to fix a portion of the toner image formed on the respective region of the print medium to provide the target image;

a control system configured to:

acquire the print information regarding the target image;

acquire the position information from the reader;

determine a heating region based on the print information and a non-heating region based on the position information;

determine whether the heating region and the non-heating region at least partially overlap;

perform an image adjustment process to manipulate the target image to eliminate an overlap between the heating region and the non-heating region in response to determining that the heating region and the non-heating region at least partially overlap;

control the image forming assembly to apply the toner image of the target image on the print medium; and control the fixing device to heat the toner image to fix the toner image on the print medium.

2. The image forming apparatus of claim 1, wherein the image adjustment process includes a moving process including moving the target image relative to the non-heating region to eliminate the overlap between the heating region associated with the target image and the non-heating region associated with the wireless tag.

3. The image forming apparatus of claim 2, wherein the control system is configured to perform the moving process in response to determining that the moving process does not cause the target image to protrude from the print medium even though the overlap between the heating region and the non-heating region is eliminated by moving the target image.

4. The image forming apparatus of claim 3, wherein the image adjustment process includes a reducing process including reducing a size of the target image to eliminate the overlap between the heating region associated with the target image and the non-heating region associated with the wireless tag, and wherein the control system is configured to perform the reducing process in response to determining the moving process causes the target image to protrude from the print medium.

5. The image forming apparatus of claim 2, wherein the control system is configured to move the target image in a direction perpendicular to a conveyance direction of the print medium during the moving process.

6. The image forming apparatus of claim 2, wherein the control system is configured to rotate the target image during the moving process.

7. The image forming apparatus of claim 2, wherein the control system is configured to translate the target image and rotate the target image during the moving process.

8. The image forming apparatus of claim 1, wherein the image adjustment process includes a reducing process including reducing a size of the target image to eliminate the overlap between the heating region associated with the target image and the non-heating region associated with the wireless tag.

9. The image forming apparatus of claim 1, wherein the image adjustment process includes (i) a moving process including moving the target image relative to the non-heating region and (ii) a reducing process including reducing a size of the target image to eliminate the overlap between the heating region associated with the target image and the non-heating region associated with the wireless tag.

10. The image forming apparatus of claim 1, further comprising a detector configured to detect a front end of the print medium as the print medium is conveyed by the conveyor assembly, wherein the control system is configured to control the reader to read the position information after a designated period of time elapses following the front end being detected by the detector.

11. The image forming apparatus of claim 1, wherein plurality of regions are aligned parallel to each other, wherein each respective region extends in a direction parallel to the conveyance direction of the print medium, and wherein the control system is configured to select a subset of the plurality of regions as the heating region based on the print information and the position information read.

12. A method for printing on a print medium with a printer, the method comprising:

acquiring, by a control system of the printer, print information regarding a target image to be applied to the print medium;

acquiring, by the control system, position information from a reader of the printer, the position information indicating a position of a wireless tag on the print medium upon which the target image is to be applied;

determining, by the control system, a heating region based on the print information and a non-heating region based on the position information;

determining, by the control system, whether the heating region and the non-heating region at least partially overlap;

performing, by the control system, an image adjustment process to manipulate the target image to eliminate an overlap between the heating region and the non-heating region in response to determining that the heating region and the non-heating region at least partially overlap;

controlling, by the control system, an image forming assembly of the printer to apply a toner image of the target image to the print medium; and controlling, by the control system, a fixing device of the printer to heat the toner image to fix the toner image on the print medium.

13. The method of claim 11, wherein the image adjustment process includes a moving process including moving the target image relative to the non-heating region to eliminate the overlap between the heating region associated with the target image and the non-heating region associated with the wireless tag.

14. The method of claim 13, wherein the control system is configured to perform the moving process in response to determining that the moving process does not cause the target image to protrude from the print medium even though the overlap between the heating region and the non-heating region is eliminated by moving the target image.

15. The method of claim 14, wherein the image adjustment process includes a reducing process including reducing a size of the target image to eliminate the overlap between the heating region associated with the target image and the non-heating region associated with the wireless tag, and wherein the control system is configured to perform the reducing process in response to determining the moving process causes target image to protrude from the print medium.

16. The method of claim 13, wherein the control system is configured to move the target image in a direction perpendicular to a conveyance direction of the print medium during the moving process.

17. The method of claim 13, wherein the control system is configured to rotate the target image during the moving process.

18. The method of claim 13, wherein the control system is configured to translate the target image and rotate the target image during the moving process.

19. The method of claim 12, wherein the image adjustment process includes a reducing process including reducing a size of the target image to eliminate the overlap between the heating region associated with the target image and the non-heating region associated with the wireless tag.

20. The method of claim 12, wherein at least one of (i) or (ii) is satisfied:

(i) wherein the image adjustment process includes (a) a moving process including moving the target image relative to the non-heating region and (b) a reducing process including reducing a size of the target image to eliminate the overlap between the heating region associated with the target image and the non-heating region associated with the wireless tag; or (ii) wherein the method further comprises:

(a) detecting, by the controller through a detector of the printer, a front end of the print medium as the print medium is conveyed through the printer by a conveyor assembly of the printer; and (b) controlling, by the control system, the reader to read the position information after a designated period of time elapses following the front end being detected.

* * * * *